US005742696A

United States Patent [19]

Walton

[11] Patent Number: 5,742,696

[45] Date of Patent: Apr. 21, 1998

[54] MODULAR TWEETER

[75] Inventor: Roger Neal Walton, Barry, England

[73] Assignee: Harman International Industries Limited, London, United Kingdom

[21] Appl. No.: 704,603

[22] PCT Filed: Apr. 5, 1995

[86] PCT No.: PCT/GB95/00791

§ 371 Date: Sep. 20, 1996

§ 102(e) Date: Sep. 20, 1996

[87] PCT Pub. No.: WO95/28065

PCT Pub. Date: Oct. 19, 1995

[30] Foreign Application Priority Data

Apr. 9, 1994 [GB] United Kingdom ..... 9407101

[51] Int. Cl.[6] ..... H04R 25/00

[52] U.S. Cl. ..... 381/156; 381/182; 381/192

[58] Field of Search ..... 381/156, 182, 381/186, 192, 194, 197, 199, 202; 181/159, 144

[56] References Cited

U.S. PATENT DOCUMENTS

| | | | |
|---|---|---|---|
| 4,965,839 | 10/1990 | Elieli | 381/192 |
| 5,602,930 | 2/1997 | Walton | 381/192 |

FOREIGN PATENT DOCUMENTS

| | | |
|---|---|---|
| 0 055 841 A1 | 7/1982 | European Pat. Off. . |
| 0 344 974 A3 | 12/1989 | European Pat. Off. . |
| 0 344 975 A2 | 12/1989 | European Pat. Off. . |
| 545712 | 6/1942 | United Kingdom . |
| 2 118 398 | 10/1983 | United Kingdom . |
| 2 122 453 | 1/1984 | United Kingdom . |

*Primary Examiner*—Huyen D. Le
*Attorney, Agent, or Firm*—Barnes & Thornburg

[57] ABSTRACT

A modular tweeter (10) is provided for inductive coupling and location within a host loudspeaker (50). The loudspeaker (50) is conventional having a pole (60) with a surrounding magnet (54) and pole plate (58) defining a gap therebetween and a voice coil (72) wound on a tubular former (64) disposed within the gap (62). The tweeter (10) comprises a diaphragm or dome (14) for producing sound having an electrically conductive skirt (28). The skirted dome (14) is supported by a support member (12) having a surface for attachment to the pole (60) of the loudspeaker and a plurality of points of support (22). A phase plug (16) is located on the opposite side of the dome (14) from the support member (12) and is connected to the support member (12) through an aperture (26) in the dome (14) in such a way that the dome (14) is locked in position whilst being free to vibrate, whereby the tweeter can be assembled before insertion into the host loudspeaker (50).

8 Claims, 3 Drawing Sheets

FIG. 1.
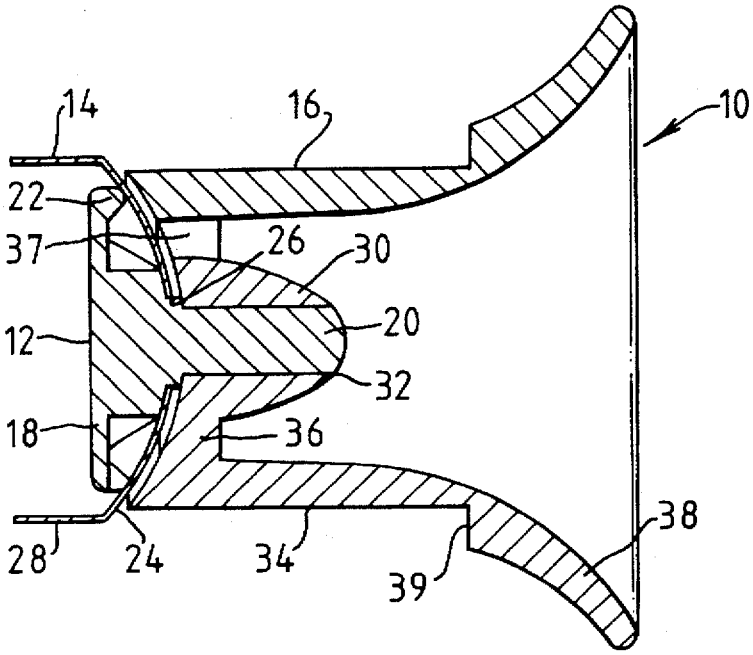
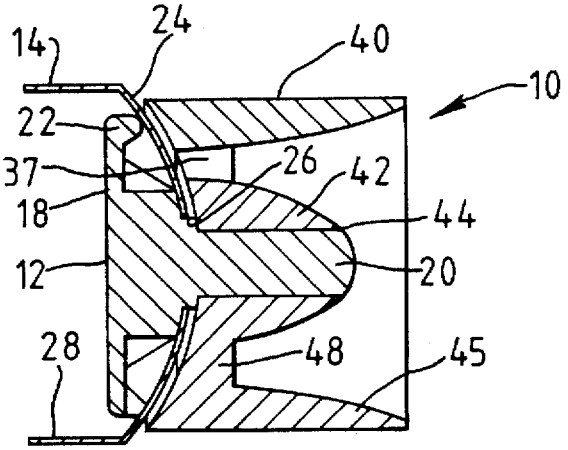
FIG. 2.
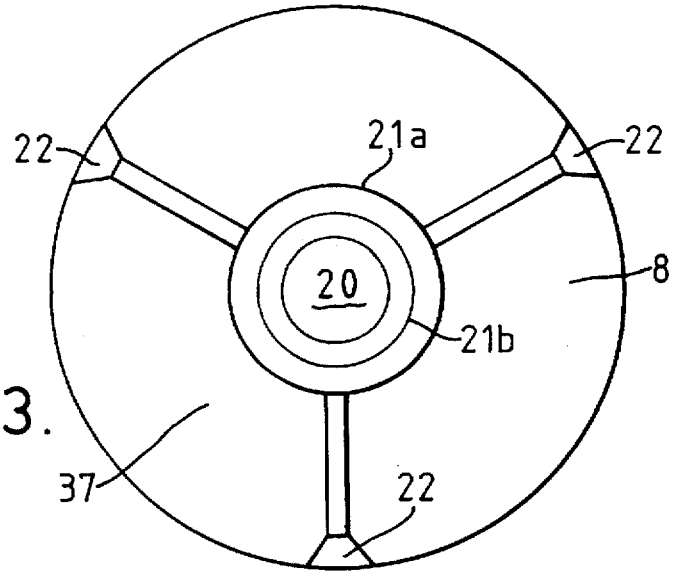
FIG. 3.

MODULAR TWEETER

FIELD OF INVENTION

The invention relates to a modular tweeter for inductive coupling and location within a loudspeaker, particularly, but not exclusively limited to, loudspeakers in television and automotive audio system.

BACKGROUND OF THE INVENTION

Loudspeakers conventionally comprise a central pole with a surrounding magnet defining an annular gap therebetween with a radial magnetic field within the gap. A voice coil is wound on a tubular former which is disposed in the gap so that the voice coil is suspended in the magnetic field. The frequency range of sound produced by this type of speaker is limited to low and medium frequency sounds. One way to produce high frequency sounds in such loudspeakers is to incorporate an inductively coupled tweeter. Such tweeters are known and have been described in patents Nos. GB-545712, GB-2118398 and U.S. Pat. No. 4,965,839.

In our International Publication No. WO94/03024, a loudspeaker is disclosed having a pole and a surrounding magnet defining an annular gap, a voice coil supported on a tubular former disposed within the gap, and a conductive skirted dome also located within the gap and supported on an insulating gasket providing three arcuate points of support. A phase plug has a projection which extends through a central opening in the dome, the projection being fixed to the pole of the loudspeaker. The phase plug also has an integral horn which extends beyond the former.

One drawback of the aforementioned inductively coupled tweeters is that the tweeter must be assembled on the top of the pole at the bottom of the coil former during assembly of the loudspeaker. Known inductively coupled tweeters can not be fitted to existing loudspeakers.

SUMMARY OF INVENTION

It is an object of the present invention to provide an improved inductively coupled tweeter.

According to the invention there is provided a modular tweeter for a loudspeaker comprising a diaphragm having an electrically conductive skirt, an aperture in the diaphragm, and a support means passing through the aperture trapping the diaphragm in such a way that it is free to vibrate whilst providing means for manipulating the modular tweeter during assembly. The support means preferably comprises a phase plug moulding on one side of the diaphragm connected through the aperture to a support body on the other side of the diaphragm within the skirt for affixing the modular tweeter to a centre pole of the loudspeaker. The phase plug moulding may include a central phase plug portion and an outer horn portion. More particularly, there is provided a modular tweeter for inductive coupling and location within a host loudspeaker, the loudspeaker having a pole with a surrounding magnet and pole plate defining a gap therebetween and a voice coil wound on a tubular former disposed within the gap, the tweeter comprising a diaphragm for producing sound having an electrically conductive skirt, means to support the diaphragm having a surface for attachment to a pole of a loudspeaker and at least one support point for supporting the diaphragm, and phase plug means arranged on the opposite side of the diaphragm from the support means and connected to the support means through an aperture in the diaphragm by connector means in such a way that the diaphragm is free to vibrate, whereby the tweeter can be assembled before insertion into a loudspeaker.

In accordance with the invention, the assembled modular tweeter can be manipulated by means of the phase plug means to avoid damaging the delicate conductive skirted diaphragm and may be fitted during manufacture or to an existing loudspeaker if desired.

The diaphragm may comprise a dome with the conductive skirt extending therefrom. The diaphragm may be made from a single material. The material is preferably a metal foil, most preferably aluminium foil.

The support means may comprise one or a plurality of support points, preferably three. The three support points are preferably equi-distant relative to each other but may be asymmetric in order to adjust performance parameters for particular requirements.

The connector means preferably comprises a male/female connector, the male part of which extends from the support means in the form of a projection. The projection preferably includes at least one shoulder whereby its diameter is reduced. The diaphragm may also be supported by the shoulder. The projection most preferably includes two shoulders and the diaphragm may be supported on the larger of the two shoulders. The projection preferably extends centrally of the support means.

The female part of the male/female connector means preferably comprises a bore in a central portion of the phase plug means for receiving the aforesaid projection. The underside of the central portion is preferably supported on the smaller shoulder, spaced from the diaphragm, to allow the diaphragm to vibrate. Alternatively, the connection may be by means of a blind hole to determine height with spacing for the diaphragm still allowing it to vibrate.

The phase plug means may also comprise a horn portion connected to the central portion by means of one or more thin webs. The horn portion may include a flared end spaced from the central portion. The horn portion preferably includes a rebate in its outer surface adjacent the flared end.

The invention also includes, in accordance with a preferred arrangement, a modular tweeter for inductive coupling and location within a host loudspeaker, the loudspeaker having a pole with a surrounding magnet and pole plate defining a gap therebetween and a voice coil wound on a tubular former disposed in the aforesaid gap, the tweeter comprising a dome support member having a surface for attachment to the loudspeaker pole, an elongate projection extending centrally from the member, and a support point spaced from the projection, the dome support member supporting a conductive skirted dome, having a central aperture formed therein through which the projection extends, and a phase plug with a central bore for receiving the projection, the dome being supported by the projection and the support point and located, upon assembly of the tweeter, between the dome support member and the phase plug, whereby the tweeter can be assembled before insertion into a loudspeaker and whereby the assembled tweeter can be fitted to an existing loudspeaker.

The dome support member may include one or more support points. Preferably three support points are provided and the support points may be substantially equi-distant relative to each other.

The dome support member may be made from a plastics material and in a preferred embodiment the dome support member is injection moulded. The dome support member preferably supports the underside of the dome.

The dome may be made from a lightweight metal foil, preferably aluminium.

The phase plug moulding may include a horn connected thereto and extending away from the dome, when the tweeter is assembled. The horn is preferably flared at its end spaced away from the phase plug. In a preferred embodiment, the horn has a rebate in its outer surface to allow free movement of the loudspeaker former and to prevent sound radiation between the former and the horn.

A loudspeaker may be provided incorporating a tweeter according to the invention or any of the consistory clauses relating thereto.

There is also provided a method of retrofitting a modular tweeter according to the invention, or any of the consistory clauses relating thereto, to an existing loudspeaker comprising the steps of:

assembling the tweeter before insertion into the loudspeaker;

inserting the tweeter into the loudspeaker former so that the conductive skirt of the diaphragm extends into the gap between the former and the pole; and securing the modular tweeter to the loudspeaker pole.

Preferably the modular tweeter is secured by applying adhesive to either the loudspeaker pole or the surface on the support means or both. However, the securing may be by screw fixing or other suitable means.

In a preferred embodiment, the method further comprises the step of testing the tweeter before insertion into the loudspeaker.

In that way the performance of the tweeter can be evaluated before it is permanently fixed in a loudspeaker ensuring that imperfect tweeters can be identified before fitting.

Embodiments of the invention will now be described in detail, by way of example, and with reference to the accompanying drawings in which:

BRIEF DESCRIPTION OF DRAWINGS

FIG. 1 is a sectional view of one embodiment of tweeter in accordance with the invention;

FIG. 2 is a sectional view of another embodiment of tweeter in accordance with the invention;

FIG. 3 is a plan view of part of either of the tweeters of FIGS. 1 or 2 shown to a larger scale;

Figure 4:
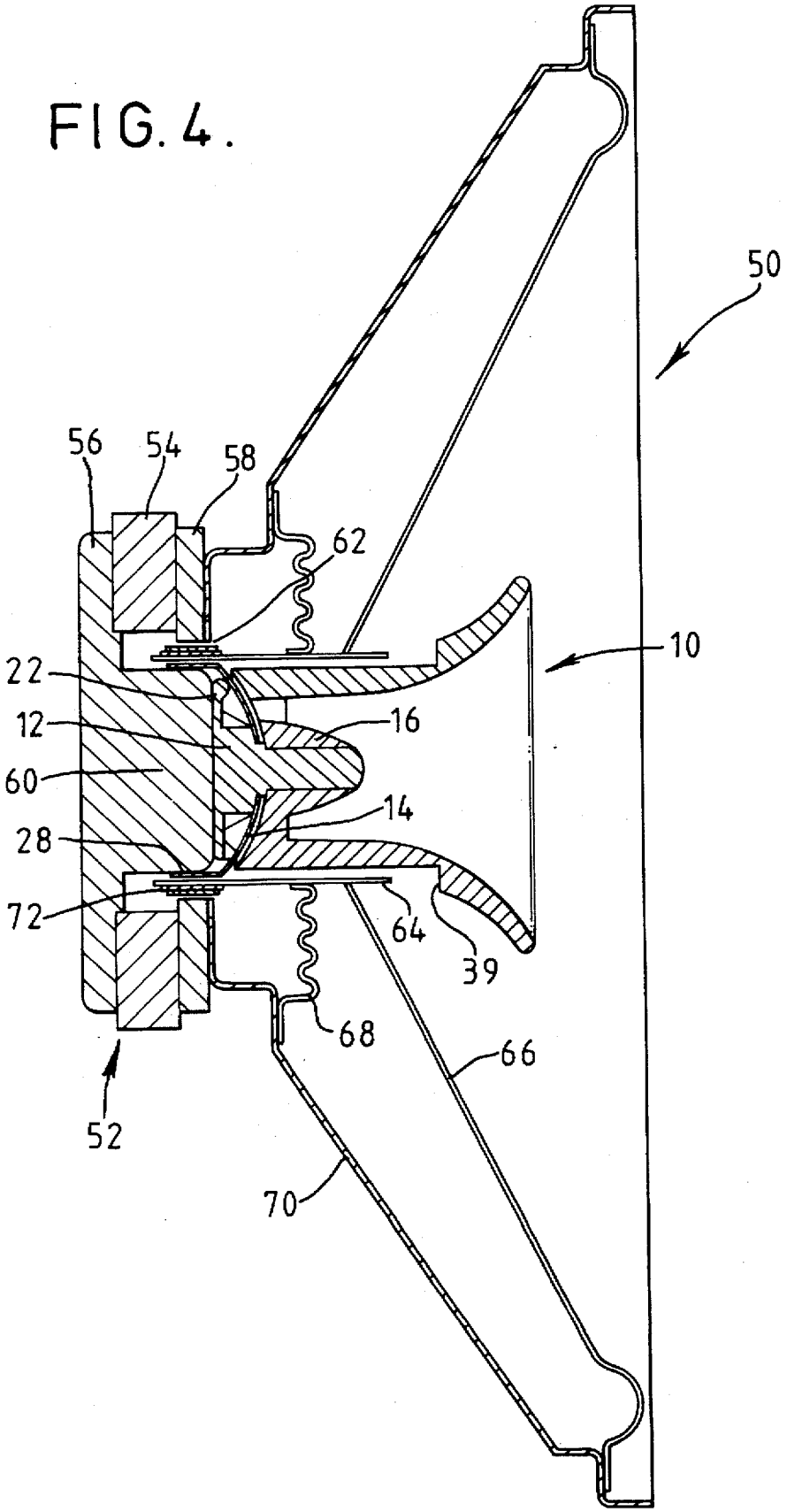
FIG. 4 is a sectional view of a loudspeaker with the tweeter of FIG. 1 fitted thereto, shown to a smaller scale.

DETAILED DESCRIPTION OF PREFERRED EMBODIMENTS in FIG. 1, a tweeter (10) comprises a dome support member (12), a conductive skirted dome (14) and a phase plug moulding (16). The dome support member (12) comprises a three-sided base (18), a projection (20) extending from the centre of the base (18) and support point(s) (22) at the edge of the base. The projection (20) extends at a first diameter to a first shoulder (21*a*) (see FIG. 3) whereupon the diameter of the projection is reduced and the projection extends at a second diameter to a second shoulder (21*b*) whence the projection extends at a third further reduced diameter. The support member (12) is an injection moulding made from a plastics material.

The conductive skirted dome (14) comprises a dome surface (24) with an aperture (26) formed centrally therein, having a diameter substantially similar to the aforesaid second diameter of the projection (20), and a cylindrical skirt (28) made from an electrically conductive material. By way of precaution, the skirt has a layer of insulating material coating the inner surface of the skirt (28) and/or on the adjacent pole face (not shown in FIGS. 1 and 3).

The phase plug moulding (16) has a central portion (30) having a bore (32) formed therein having a diameter substantially similar to the aforesaid third diameter of the projection (20). The phase plug moulding (16) also includes a horn portion (34) attached to the central portion (30) by means of thin webs (36) and serves to radiate sound generated by the dome (14) and passing through the passage (37) in the phase plug moulding (16). The horn portion (34) has a flared end (38) spaced from the end attached to the central portion (30). The horn portion (34) has a rebate (39) in its outer surface whose purpose will be described below.

In order to assemble the tweeter (10), the conductive skirted dome (14) is placed on the dome support member such that the projection (20) extends through the central aperture (26) in the dome, the dome fitting snugly around the second shoulder (21*b*). The dome is supported by the dome support member (12) at the support points (22) and by the first shoulder (21*a*) of the projection (20). The dome (14) is physically attached to the first shoulder (21*a*) and to the support points (22) by adhesive or other suitable means. The phase plug moulding (16) then receives the projection (20) in the bore (32) of the central portion (30). The phase plug moulding (16) is pushed on to the projection until the underside of the central portion (30) abuts the second shoulder (21*b*) of the projection (20).

In FIG. 2, another embodiment of the modular tweeter (10) is shown. The tweeter of FIG. 2 is similar in many ways to the tweeter of FIG. 1 and parts corresponding to parts in FIG. 1 carry the same reference numerals. The tweeter (10) comprises a dome support member (12), a conductive skirted dome (14) and a shortened phase plug moulding (40). The dome support member (12) and the conductive skirted dome (14) are substantially similar to those shown in FIG. 1 and will not be described further.

The shortened phase plug moulding (40) comprises a central portion (42) having a bore (44) substantially similar in diameter to the third reduced diameter of the projection (20). The phase plug moulding (40) further comprises a shortened horn portion (45) which is connected to the central portion (42) by means of thin webs (48).

The tweeter of FIG. 2 is assembled in a substantially similar manner to that of FIG. 1.

Figure 5:
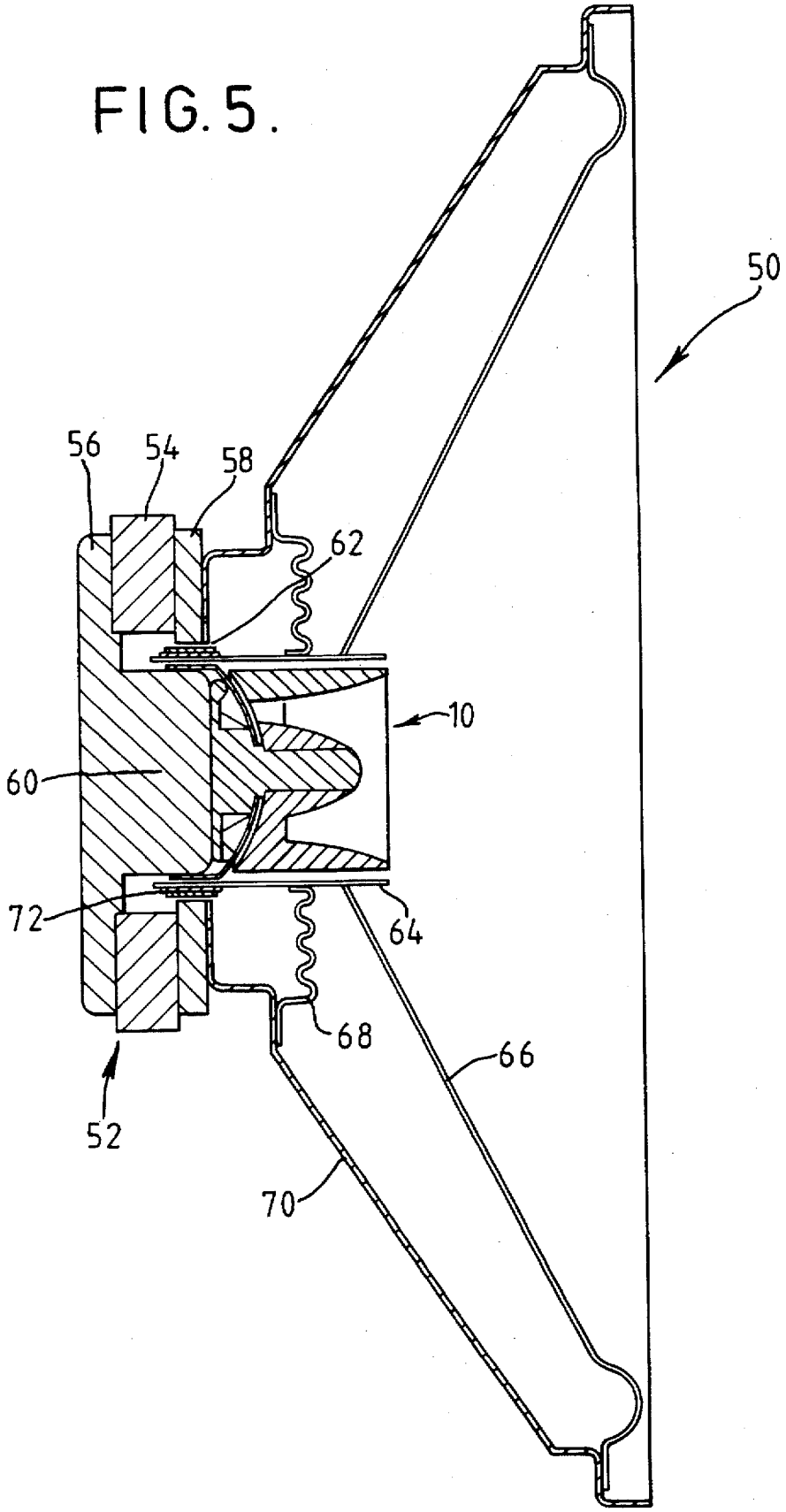
FIG. 5 is a sectional view of a loudspeaker with the tweeter of FIG. 2 fitted thereto shown to a smaller scale.

FIGS. 4 and 5 show the tweeters of FIGS. 1 and 2 assembled into a conventional loudspeaker. In those Figures the loudspeaker (50) comprises a conventional back assembly (52) including a magnet ring (54) having a yoke (56) and an annular front plate (58) bonded to the magnet ring (54). The yoke (56) includes a cylindrical pole (60) extending through openings defined by the annular plate (58) and the magnet ring (54) to define an annular gap (62). A tubular former (64) carried by a diaphragm (66) and a flexible suspension (68) connected to a fixed chassis (70) of the loudspeaker (50) extends into the gap (62). A voice coil (72) is wound over the former (64) and lies within the gap (52).

The modular tweeters (10) of FIGS. 1 and 2 can be inserted within the tubular former (64) such that the cylindrical skirt (28) of the conductive skirted dome (14) extends into the gap defined between the tubular former (64) and the centre pole (60). An insulating coating to the inner surface of the dome (14) and/or on the adjacent surface of the pole (60) prevents a drop in induced current if the skirt accidentally contacts the pole (60). The horn is a close fit within the former but the two do not make contact. The rebate (39) in the horn portion (34) of the tweeter (10) of FIG. 1 allows sufficient clearance between the tweeter and the tubular former (64) so that the former can vibrate. The underside of the base (18) of the dome support member (12) can be attached to the centre pole (60) by means of, for example, adhesive.

Thus, the modular tweeter can be assembled independently of its host loudspeaker and tested against imperfection of performance before insertion into a loudspeaker.

The loudspeaker (50) may further comprise a dust ingress preventing screen (not shown) which, in the case of the FIG. 5 arrangement, can be of standard construction, but in the FIG. 4 arrangement would require a different design to accommodate the protrusion of horn (34). The dust ingress preventing screen is usually made from a dust-proof acoustically transparent domed cloth across the mouth of the horn flare and an annular, flexible dust seal between the outer face of the horn flare and the diaphragm or former. The annular dust seal is preferably acoustically opaque and, in FIG. 4, may suitably comprise a thermally formed foam roll attached between the rebate (39) on the horn above the tubular former (54) and the face of the diaphragm (66) exactly level with the position of the rebate (39).

A further advantage of the modular tweeter is that existing loudspeakers without inductively coupled tweeters can be retro-fitted with the modular tweeter according to the invention.

The tweeter operates by the alternating current in the voice coil (72) of the host loudspeaker (50) inducing a current in the skirted part (28) of the dome (14). The current in the skirt (28) interacts with the radial magnetic field between pole (60) and surrounding magnet (54) and the dome (14) is caused to move. The signal applied to the voice coil (72) thus results in the dome (14) vibrating accordingly to produce high frequency sounds which are radiated through the openings (37).

Because the shortened horn of FIG. 2 does not have the rebate of FIG. 1, some sound may be radiated by the edge of the dome (14) via the annular gap between the former (64) and the moulding (16). This will be of a different phase from that radiated by the dome via the main annular gap (37) between the phase plug (30) and the horn (16). This may cause some irregularities in the performance. This may be stopped by designing a lip (not shown) to project from the forward outer edge of the horn (45) to project over the edge of the coil tube (64) allowing enough room for the coil to vibrate without making contact. This lip need not detract from the advantage of the short horn, that of allowing the use of a conventional domed dust cover adhered to the cone only. However, the short horn of FIG. 2 will not perform as well as the flared horn of FIG. 1 which may require additional dust-proofing, depending on the application.

The dome support member (12) and the phase plug moulding (16,40) are preferably made from plastics material, while the conductive skirted dome is made from a thin metal foil, preferably aluminium foil due to its lightness and high electrical conductivity. If desired, the support point or points (22) may be made slightly resilient by the provision of one or more pads of neoprene or like material.

An inductively coupled tweeter is extremely thin and consequently very fragile. Any damage during handling, for example by denting, will cause performance irregularities. The present invention therefore provides several advantages:

(i) it enables the tweeter to be assembled separately and provides a means whereby the tweeter can be tested and/or installed without the dome itself being touched;

(ii) it avoids the need for the phase plug to be screwed to the centre pole and therefore no drilling is required in the centre pole.

(iii) it allows the tweeter to be retro-fitted to a loudspeaker;

(iv) the fitting of the tweeter does not require the diaphragm to be touched by hand during insertion into the voice coil former;

(v) the induction tweeter can have repeatable performance parameters because its performance is not affected by the fitting operation;

(vi) the induction tweeter need not be assembled at the same location to that where the speaker is made, and may be assembled by a subcontractor.

(vii) in some arrangements described, the induction tweeter can be assembled using no self adhesive gaskets; and, (viii) an induction tweeter can be made having a known, and fixed, moving mass with improved polar response.

Although the preferred method of attachment of the foil dome (14) and the plastic phase plug/horn (16;40) has been described, other methods may be used. For example, the phase plug may be arranged to screw down a threaded post and its height be determined by a washer which would clamp the dome. This would avoid gluing the dome to the central post and provide the necessary spacing to allow the dome (14) to vibrate without touching the moulding. Also, the support for the dome could comprise a number, eg. three, 'pimples' on the underside of the phase plug which correspond with the points of support (22) on the dome support member (12). The phase plug then slides down a post of triangular section to a 'click-fit' at the correct height. The pimples would then, by alignment with the support places on the base moulding, physically clamp the dome at those places pinching the dome between the pimples and the points of support (22), adhesive then being unnecessary. The central part of the dome may similarly be either glued or clamped, with or without spacing washers according to the preferred design.

The dome may also be initially assembled to the underside of the phase plug on a peg that is subsequently inserted into a matching hole in the plastic moulding that is then subsequently stuck to the pole face.

I claim:

1. A tweeter for mounting to a front of a center pole of a stator of a moving coil loudspeaker, the stator including the center pole and an annular outer pole defining between them an air gap, the tweeter including a support member and a skirted dome having a dome-shaped forward radiating surface and a conductive skirt, the forward radiating surface including a central opening, the skirt extending rearwardly from the forward radiating surface for extension into the air gap of an assembled loud speaker, the support member having a front portion, a back portion and a post portion extending from the back portion to the front portion, the back portion and the post portion being formed in a single unit the support member portions constituting at least two separable members, said separable members being joined together in the front portion, and the post portion having a first cross section that permits it to extend through the central opening of the dome, the back and front portions each having second and third cross sections respectively that prevent them from passing through the central opening of the dome, wherein when the support member has said separable members joined with the dome, the dome is positioned with the post portion extending through the central opening and between the second and third cross sections to capture the dome between the front and back portions of the tweeter.

2. A tweeter according to claim 1, wherein the diaphragm (14) is aluminum foil material.

3. A tweeter according to claim 1, wherein the support member (12) comprises a plurality of support points (22).

4. A tweeter according to claim 3, wherein there are three support points (22) equi-distant relative to each other.

5. The tweeter of claim 1 wherein the front portion comprises a phase plug, the post extending forward from the back portion, the phase plug including a second opening in a rearwardly facing surface of the phase plug for receiving the post to capture the dome between the front and back portions of the tweeter.

6. A tweeter according to claim 5, wherein the support member (12) includes three support points (22) and the diaphragm (14) is further supported by a shoulder (21*a*) on a projection passing between the support member (12) and the phase plug (16), the diaphragm (14) being physically attached to the shoulder and the support points by adhesive.

7. The tweeter of claim 1 wherein the front portion comprises a horn, the post extending forward from the back portion, the horn including a second opening in a rearwardly facing surface of the horn for receiving the post to capture the dome between the front and back portions of the tweeter, a rearwardly facing third opening providing a passage for sound from the radiating surface to the horn, and a forwardly facing fourth opening providing a passage for sound from the horn to a listening environment.

8. The tweeter of claim 1 wherein the front portion comprises a combination phase plug and horn, the support post extending forward from the back portion, the combination phase plug and horn including a second opening in a rearwardly facing surface of the phase plug for receiving the support post to capture the dome between the front and back portions of the tweeter, the horn having at least one rearwardly facing third opening providing a passage for sound from the radiating surface to the horn and a forwardly facing fourth opening providing a passage for sound from the horn to a listening environment, and at least one connecting rib extending between the phase plug and the horn to support the horn from the phase plug.

* * * * *